United States Patent [19]

O'Dell

[11] 4,190,296

[45] Feb. 26, 1980

[54] APPARATUS FOR INTERCONNECTING SEGMENTED CUTTER DRUMS OF A ROTARY CUTTER MECHANISM

[75] Inventor: Larry A. O'Dell, Columbus, Ohio

[73] Assignee: Dresser Industries, Inc., Dallas, Tex.

[21] Appl. No.: 915,285

[22] Filed: Jun. 13, 1978

[51] Int. Cl.[2] ..... E21C 25/10

[52] U.S. Cl. ..... 299/89; 403/310

[58] Field of Search ..... 299/87, 89, 76, 78; 403/310, 336, 344, 374; 164/384–388; 51/206.5

[56] References Cited

U.S. PATENT DOCUMENTS

| | | | |
|---|---|---|---|
| 2,932,496 | 4/1960 | Barrett | 299/89 X |
| 3,307,880 | 3/1967 | Newton et al. | 299/89 X |
| 3,601,429 | 8/1971 | Coski | 403/310 |
| 3,995,685 | 12/1976 | Stanko | 403/374 X |

*Primary Examiner*—Ernest R. Purser

*Attorney, Agent, or Firm*—Burns, Doane, Swecker & Mathis

[57] ABSTRACT

The present invention involves a machine for cutting earth formations, of the type comprising a vehicle body, a cutter drum mounted on the vehicle body, and a drive mechanism for rotating the cutter drum. The cutter drum includes a plurality of segments of a cylinder, and a connector for connecting the drum segments together. The drum segments each include at one end thereof a reaction surface inclined in a direction extending longitudinally outwardly and radially inwardly. The connector comprises a connector ring and a fastener. The connector ring includes an inner peripheral surface inclined in a direction complimentary to that of the reaction surfaces such that the connector ring is able to fit over the reaction surfaces. The fastener imposes generally longitudinally inward forces on the connector ring to urge the inner peripheral surface of the ring into wedging engagement with the reaction surfaces to urge the drum segments together.

10 Claims, 8 Drawing Figures

APPARATUS FOR INTERCONNECTING SEGMENTED CUTTER DRUMS OF A ROTARY CUTTER MECHANISM

BACKGROUND AND OBJECTS OF THE INVENTION

This invention relates to apparatus for the cutting of earth formations and, more particularly, to the mounting of drum-type cutters on mining machines.

Machines for cutting earth formations such as coal and other mineral deposits, rocky soil, etc., often employ rotary cutters comprising cylindrical cutter drums which carry pointed cutter bits. The cylindrical drums are connected to a rotary drive shaft which rotates the drums at the same time that the cutter is advanced against an earth formation to cut therethrough.

In some mining machines, for example, carrier arms extend forwardly from a vehicle body and carry a rotary cutter mechanism which rotates about a transverse horizontal axis. The cutter mechanism comprises a support housing and a drive shaft assembly rotatably mounted within the housing, and a series of longitudinally spaced cutter drums connected to the drive shaft assembly to be rotatably driven thereby.

Some of the cutter drums (outside drums) are located to the outside of the carrier arms and comprise one-piece cylinders which can be slid axially over the housing and suitably fastened in place. Others of the drums (inside drums) are located between the carrier arms. These inside drums cannot be conveniently removed in an axial direction and thus are usually formed of semi-cylindrical segments which can be separated radially to provide access to the support housing and drive shaft assemblies for maintenance.

It has heretofore been proposed to connect the segments of the inside drum by means of bolts oriented perpendicularly or orthogonally relative to the axis of rotation. Because of this orientation, however, the bolts are subjected to such intensive stress acting along the bolt axis, that the bolts often become stretched, thereby allowing the drum segments to separate. Consequently, work must be stopped in order to replace the bolts. Oftentimes, an operator simply removes the bolts and welds the semi-cylindrical members together. This latter practice avoids the bolt-stretching problem but greatly complicates maintenance operations since the drum can only be removed in an axial direction, thus requiring substantial dissemblage of the cutter mechanism.

It is, therefore, an object of the present invention to minimize or obviate problems of the type discussed above.

It is a further object of the invention to enable cutter drum segments to be removably fastened together while minimizing chances that the drum segments will separate during operation.

It is yet another object of the invention to enable cutter drum segments to be connected by bolt type fasteners while minimizing the stresses to which the bolts are subjected during cutter operation.

BRIEF SUMMARY OF A PREFERRED EMBODIMENT OF THE INVENTION

These objects are achieved by the present invention which involves a machine for cutting earth formations, of the type comprising a vehicle body, a cutter drum mounted on the vehicle body, and a drive mechanism for rotating the cutter drum. The cutter drum includes a plurality of segments of a cylinder, and a connector for connecting the drum segments together. The drum segments each include at one end thereof a reaction surface inclined in a direction extending longitudinally outwardly and radially inwardly. The connector comprises a connector ring and a fastener. The connector ring includes an inner peripheral surface inclined in a direction complimentary to that of the reaction surfaces such that the connector ring is able to fit over the reaction surfaces. The fastener imposes generally longitudinally inward forces on the connector ring to urge the inner peripheral surface of the ring into wedging engagement with the reaction surfaces to urge the drum segments together.

THE DRAWING

Other objects and advantages of the present invention will become apparent from the following detailed description of a preferred embodiment thereof in connection with the accompanying drawings in which like numerals designate like elements and in which.

DETAILED DESCRIPTION OF A PREFERRED EMBODIMENT OF THE INVENTION

Figure 1:
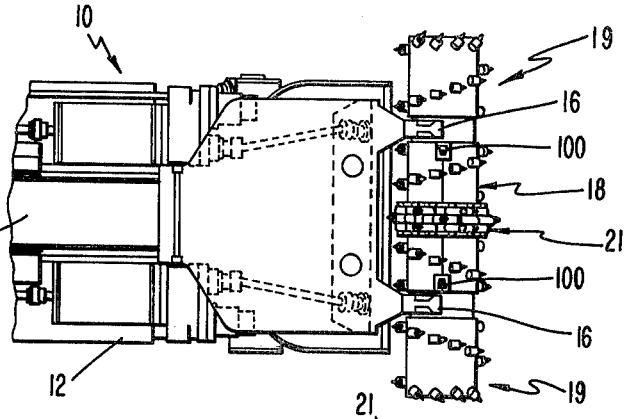
FIG. 1 is a plan view of a mining machine embodying improvements according to the present invention.
Figure 2:
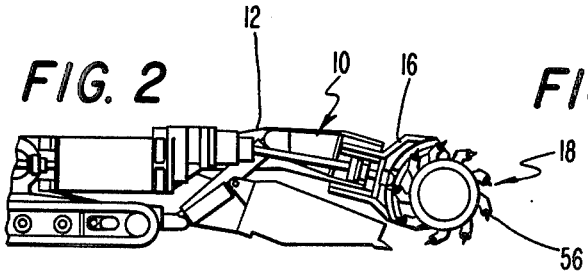
FIG. 2 is a side elevational view of the machine depicted in FIG. 1.
Figure 3:
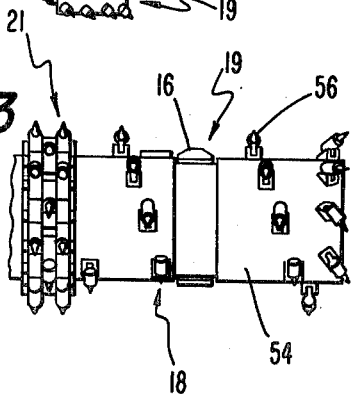
FIG. 3 is a front elevational view of a portion of a cutter drum assembly carried at the front of the mining machine.

A preferred embodiment of the invention will be discussed in conjunction with a mining machine 10 shown in FIGS. 1 and 2. The mining machine 10 comprises a self-propelled vehicle body 12. A longitudinal conveyor 14 on the vehicle body 12 functions to transfer excavated materials from a front end of the vehicle body 12 to a rear discharge end thereof. Extending forwardly of the vehicle body 12 are a pair of support arms 16 which support a rotary cutter assembly 18 extending across the front end of the vehicle body. The cutter assembly 18 includes a drum-type cutter mechanism 19 at each end of the cutter assembly 18, separated by a central chain-type cutter 21. The cutter mechanisms 19 are identical, and therefore only one such mechanism will be described in detail below.

Each cutter mechanism 19 includes a support frame assembly 20, a drive assembly 22 mounted on the support frame assembly 20, and a plurality of rotary cutter drums 26 connected to the drive assembly to be driven thereby.

The support frame assembly 20, and drive assembly 22 are of conventional construction and will be discussed only briefly. The support frame assembly includes a hollow support shell 28 rigidly fastened to the associated support arm 16. The shell includes a plurality of interconnected support tubes 30, 32, 34. A roller bearing 38 is mounted in the tube 32 to rotatably support a drive shaft section 40 of the drive assembly 22. A gear 42 is connected to the drive shaft section 40 and is driven by a drive train 44 extending through the arm 16.

The drive assembly 22 further comprises a rotary carrier 46 which is rotatably mounted within the tube 34 by means of spaced roller bearings 48. The carrier 46 has internal gear teeth which are in mesh with a gear 50, the latter being connected to the drive shaft section 40 by means of a drive shaft section 52.

Rigidly fastened by bolts 53 to the carrier 46 outside of the arm 16 is a cutter drum or auger drum 54. This outer cutter drum 54 is generally cylindrical and fits over the outside of the carrier 46. A plurality of cutter bits 56 are carried in a helical pattern on the outside surface of the drum 54.

The drive assembly 22 further includes a drive shaft section 60 which is connected to the main drive train 44 through the gear 42 and a series of gears 62, in conventional fashion. The drive shaft section 60 is rotatably mounted in a bearing 64 carried by the tube 30.

Figure 4:
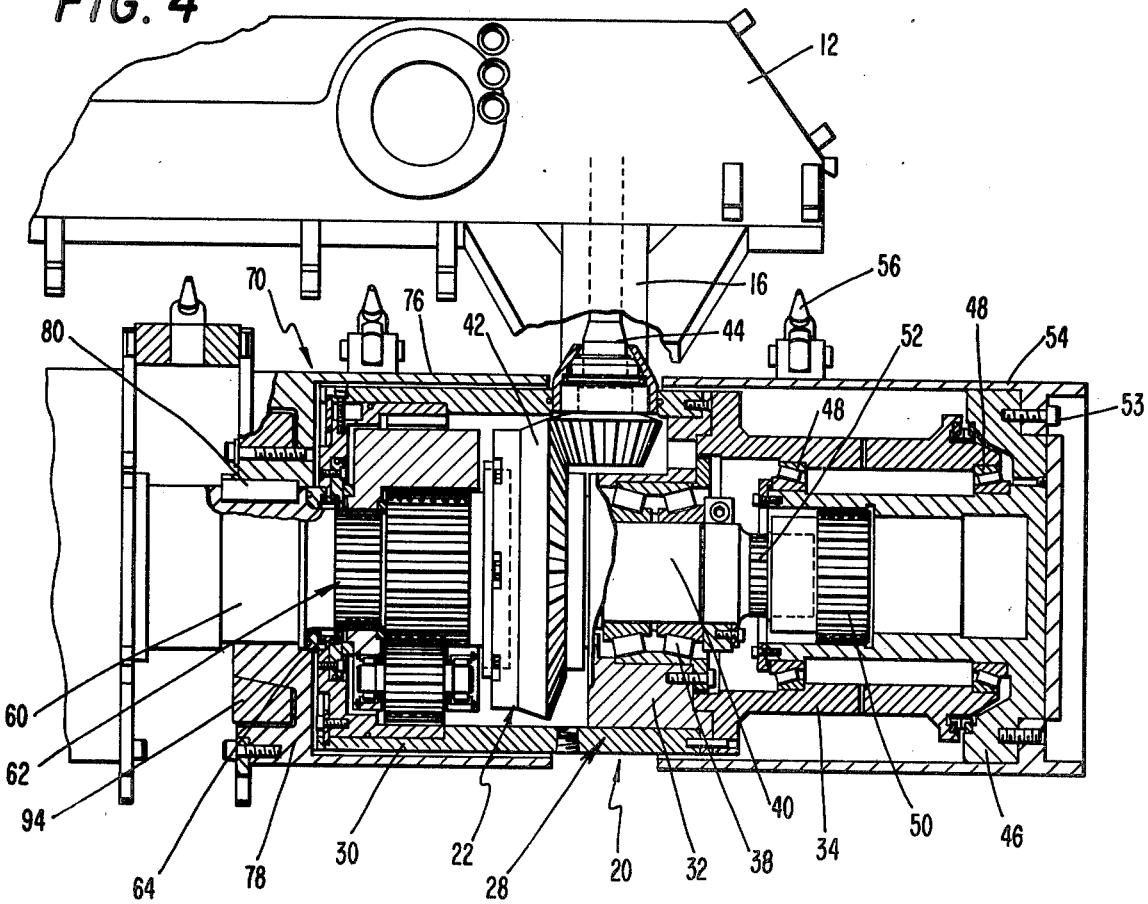
FIG. 4 is a plan view, with parts broken away, of the portion of the center drum assembly shown in FIG. 3.
Figure 5:
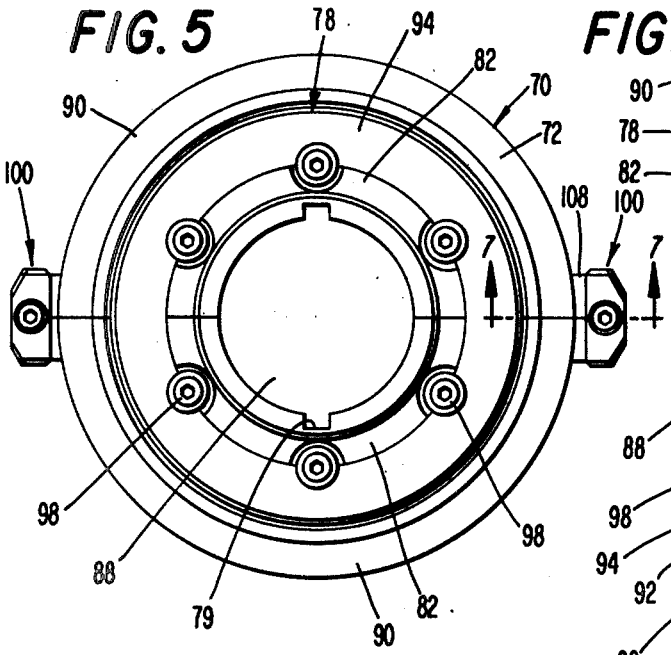
FIG. 5 is an end view of a segmented cutter drum connected together by means of a connector ring, with the drive shaft removed from the center of the drum.
Figure 6:
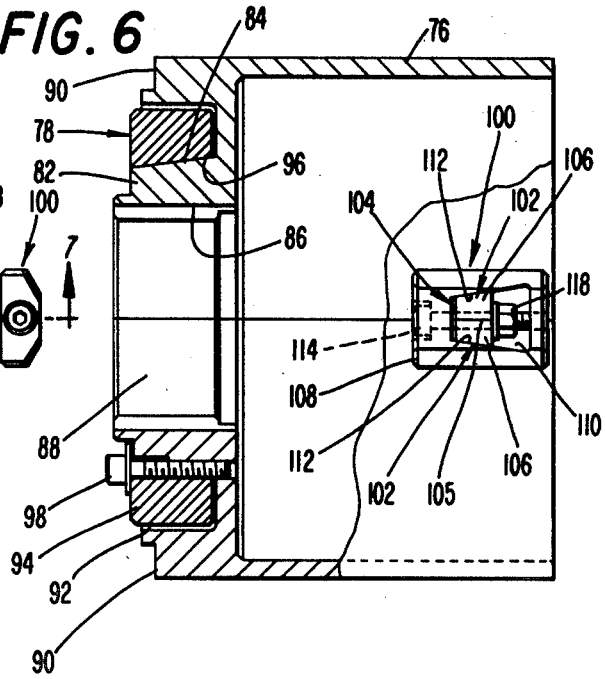
FIG. 6 is a side elevational view of the drum depicted in FIG. 5 with a portion broken away to show the connector ring in cross-section.
Figure 7:
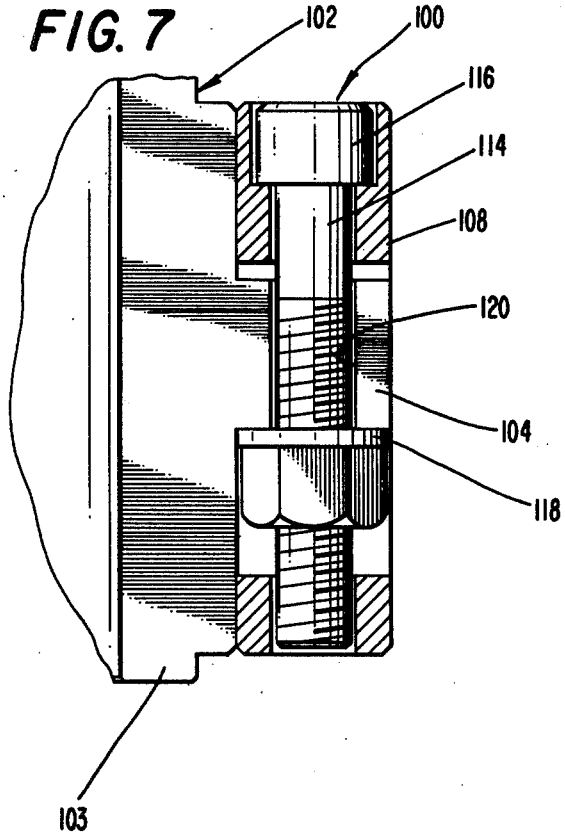
FIG. 7 is a cross-sectional view of a clamping assembly according to the present invention, taken along the line 7—7 in FIG. 5.
Figure 8:
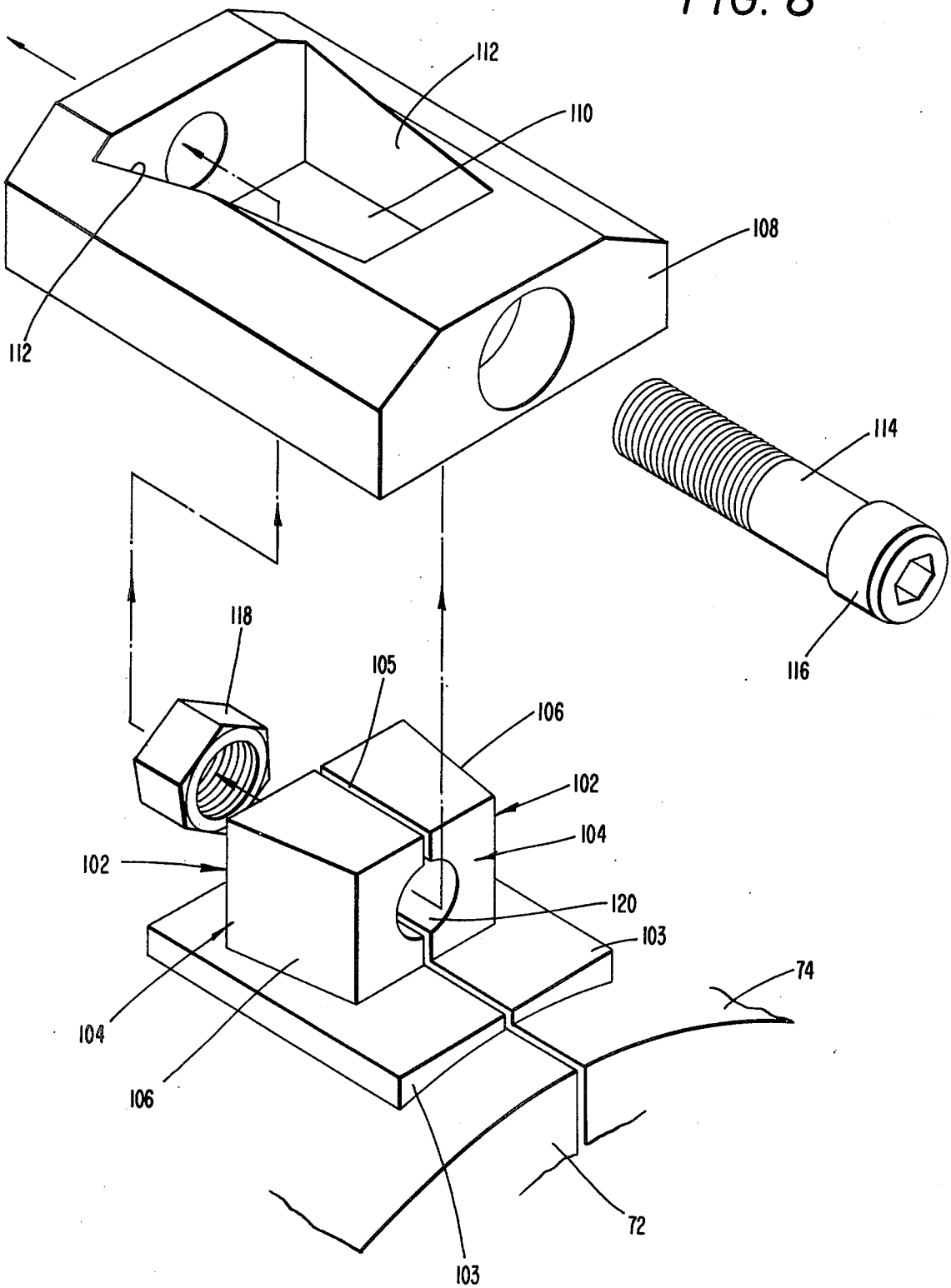
FIG. 8 is an exploded perspective view of the clamping assembly shown in FIG. 7.

Situated to the inside of the arm 16 (i.e., to the left in FIG. 4) is a cutter drum 70. This inner drum 70 is generally cylindrical in shape and comprises two semi-cylindrical segments 72, 74 (FIG. 5) that are coupled together in a manner to be discussed. The drum includes a skirt portion 76 disposed around the outside of the tube 30, and a hub portion 78 at one end of the skirt portion 76. The inner drum 70 is connected for rotation with the drive shaft section 60 by means of keys 80 situated in key slots 79 in the hub portion 78 and in the drive shaft section 60 (FIG. 4).

The structure described in the foregoing is of conventional design and well known to those skilled in the art.

In accordance with the present invention, the hub 78 of each drum segment 72, 74 includes a block 82 which projects longitudinally outwardly from the end of the drum 70. The blocks 82 are of generally semi-cylindrical configuration and include outer peripheral surfaces, or reaction surfaces, 84 which are inclined in a direction extending longitudinally outwardly (relative to the drum 70) and radially inwardly. These surfaces 84 are circumferentially aligned to form a frusto-conical surface when the drum segments are connected together. The inside walls 86 of the blocks 82 form a central bore 88 which receives the shaft section 60.

Each drum segment also includes a semi-cylindrical projection 90 which is situated radially outwardly of the outer peripheral surfaces 84 to form halves of a circular channel 92.

Disposed in clamping relation with the blocks 82 is an annular connector ring 94. The connector ring 94 is of solid, one piece construction and includes an inner peripheral surface, or connector surface 96, which is inclined in complementary manner relative to the inclined outer peripheries 84 of the blocks 82, i.e., in a direction extending longitudinally inwardly (relative to the drum 70) and radially outwardly. The angles of inclination of the outer and inner peripheral surfaces 84, 96 relative to the drum axis are essentially the same, preferably about 5 to 15 degrees. Thus, the inner surface 96 of the connector ring 94 is of frusto-conical configuration and fits over the frusto-conical surface form by the outer peripheries 84 of the blocks 82.

The connector ring 94 can be installed by being longitudinally inserted into the channel 92 and over the blocks 82.

The connector ring is fastened to the drum segments 72, 74 by fasteners which impose generally longitudinally inward forces on the connector ring to urge the inner peripheral surface 96 into wedging engagement with the outer peripheral surfaces 84 of the blocks 82. Preferably, these fasteners comprise bolts 98 which are inserted longitudinally into holes, one radial half of each hole formed in the connector ring 94 and the other radial half formed in the drum segments 72, 74. By tightening the bolts 98, the connector ring 94 is drawn toward the blocks 82, thereby causing the inner peripheral surface 96 of the connector ring to contact the outer peripheral surfaces of the blocks 82 to wedge or force the drum segments 72, 74 together.

During subsequent rotational operation of the drum 70 the radial forces tending to separate the drum segments 72, 74 are effectively resisted by the connector ring 94. The forces acting against the inner peripheral surface 96 will include a longitudinally outwardly directed component, but the magnitude of such longitudinal force component is relatively small and easily resisted by the bolts 98. Thus, there is minimal likelihood of the bolts becoming stretched.

The drum segments 72, 74 are also coupled together at ends thereof located opposite the ends containing the blocks 82. This is achieved by a pair of clamping assemblies 100 located at the two interfaces between the skirts 76 of the drum segments 72, 74. The clamping assemblies 100 are identical and thus only one will be described in detail.

Each clamping assembly 100 includes a pair of fixtures 102 comprising a base 103 and a wedge member 104. The base 103 of each fixture 102 is secured to the outer surface of a drum segment 72 or 74 such that the fixtures are secured to respective drum segments 72, 74 and are disposed in side-by-side relationship when the drum halves are coupled together.

The wedge members 104 include proximate side surfaces 105 disposed in abutting relationship when the drum segments 72, 74 are coupled together, and remote side surfaces, or wedge surfaces, 106 which are inclined relative to one another.

A separate clamp member 108 is provided for clamping the wedge members 104 together. This clamp member 108 includes a recess 110 which receives the wedge members 104. Opposite side walls 112 of the recess 110 form clamping surfaces which are mutually inclined in complimentary fashion to the inclined relationship between the wedge surfaces 106 of the wedge members 104.

Clamping engagement between the clamp member 108 and the wedge members 104 is achieved by means of a threaded bolt 114 which includes a head portion 116 acting against the clamp member 108, and a nut and washer portion 118 acting against both wedge members 104. The bolt extends in a longitudinal direction (relative to the drum 70) through a passage 120, one radial half of which passage is formed in one wedge member, and the other radial half of which is formed in the other wedge member. By tightening the bolt 114 the clamping surfaces 112 are urged against the wedge surfaces 106 to wedge or cam the drum halves 72, 74 together.

The radial forces generated during operation of the drum 70 will be resisted by the clamp member 108, with the longitudinal bolts 114, being subjected to longitudinal forces of much smaller magnitude which they can easily resist without stretching.

The cutting assembly 18 is assembled in conventional fashion, with the exception that the connector ring 94 of the present invention is mounted loosely on the drive shaft assembly 22 before the latter is connected to the support frame assembly 20. The outer drum 54 is longitudinally installed over the carrier 34 and bolted thereto. The drum halves 72, 74 of the inner drum 70 are inserted around the support tube 30 such that the blocks 82 are in circumferential alignment. The previously-installed connector ring 94 is slid over the blocks 82 and by tightening the bolts 98 the inner surface 96 thereof is urged into tight engagement with the outer surfaces 84 of the blocks by means of the bolts 98, to secure the hub ends of the drum halves firmly together.

The other ends of the drum halves are secured by positioning the clamp members 108 onto the associated wedge members 104, and tightening the bolts 114. In this fashion the clamp surfaces 112 of the clamp member are urged into engagement with the wedge surfaces 106 of the wedge members 104 to tightly clamp the drum halves together.

It will be appreciated that the drum halves 72, 74 can be easily separated to afford access to the support frame assembly 20 and drive assembly 22 for maintenance work. Moreover, the bolt fasteners 98 and 112 securing the ends of the drum halves 72, 74 together are acted upon longitudinally by forces of relatively small magnitude, thereby minimizing the chances of the bolts becoming stretched. The connector ring 94 and the wedge members 108 easily withstand the more substantial radial forces which are generated during cutting operations.

Although the invention has been described in connection with a preferred embodiment thereof, it will be appreciated by those skilled in the art that additions, modifications, substitutions and deletions not specifically described may be made without deparing from the spirit and scope of the invention as defined in the appended claims.

What is claimed is:

1. In a machine for cutting earth formations, of the type comprising a vehicle body, a cutter drum mounted on said vehicle body, and means for rotating said cutter drum, said cutter drum including a plurality of segments of a cylinder, and connector means connecting said drum segments together, the improvement wherein:

(a) said drum segments each include at one end thereof a reaction surface inclined in a direction extending longitudinally outwardly and radially inwardly; and (b) said connector means comprising:

(i) a connector ring including an inner peripheral surface inclined in a direction complimentary to that of said reaction surfaces such that said connector ring is able to fit over said reaction surfaces, (ii) fastener means for imposing generally longitudinally inward forces on said connector ring to urge said inner peripheral surface of said ring into wedging engagement with said reaction surfaces to urge said drum segments together, (iii) a plurality of clamping means located adjacent an end of said drum opposite the end containing said reaction surfaces, each clamping means comprising a pair of side-by-side wedge members secured to respective ones of adjacently disposed drum segments, each wedge member including a wedge surface, said wedge surfaces being mutually inclined, and (iv) a separate clamp member including a pair of clamp surfaces which are mutually inclined in complimentary relation to said wedge surfaces, said clamp member being positioned such that said clamp surfaces engage respective ones of said wedge surfaces, and means for urging said clamp member and said wedge members together to bring said clamp surfaces into clamping relationship with associated ones of said wedge surfaces to secure said drum segments together.

2. Apparatus according to claim 1, wherein said drum segments comprise two generally semi-cylindrical segments, said segments each including longitudinally outwardly extending blocks the outer peripheral surfaces of which define said reaction surfaces, said outer peripheral surfaces being alignable circumferentially to form a frusto-conical surface.

3. Apparatus according to claim 2, wherein said blocks include internal surfaces which define a central aperture through said end of said drum to receive a drive shaft section of said drum rotating means.

4. Apparatus according to claim 1, wherein said fastener means comprises longitudinally extending threaded bolts.

5. Apparatus according to claim 1 and further including a pair of wedge members mounted on respective ones of said drum segments adjacent an end of said drum opposite the end containing said reaction surfaces, and a clamp member for urging said wedge members together to secure said drum segments together.

6. Apparatus according to claim 1, wherein said drawing means comprises a threaded bolt connected between said wedge members and said clamp member and disposed in a longitudinal direction.

7. In a mining machine of the type comprising a vehicle body, a pair of arms extending forwardly from said vehicle body, and a cutter assembly mounted on said arms, said cutter assembly including a drive shaft assembly mounted for rotation about a horizontal transverse axis, and a plurality of cutter drums connected to said drive shaft assembly to be driven thereby, said cutter drums including a first pair of cutter drums located longitudinally outwardly of said arms and a second pair of drums located between said arms, each of said second drums comprising a pair of semi-cylindrical segments and a series of cutter bits mounted thereon, and connector means for coupling said drums together, the improvement wherein:

(a) said drum segments include semi-cylindrical blocks projecting longitudinally outwardly at one end of said drum, said blocks being circumferentially aligned to form a frusto-conical outer peripheral surface; and (b) said connector means comprising:

(i) a connector ring having a frusto-conical internal peripheral surface shaped complimentary to said outer peripheral surface such that said connector ring fits over said blocks, (ii) a plurality of longitudinally extending bolts connecting said ring to said drum segments and urging said inner peripheral surface into clamping engagement with said outer peripheral surface to connect said drum segments together, (iii) a plurality of clamping means located adjacent an end of said drum opposite the end containing said blocks, each clamping means comprising a pair of side-by-side wedge members secured to respective ones of adjacently disposed drum segments, each wedge member including a wedge surface, said wedge surfaces being mutually inclined; and (iv) a separate clamp member including a pair of clamp surfaces which are mutually inclined in complimentary relation to said wedge surfaces, said clamp member being positioned such that said clamp surfaces engage respective ones of said wedge surfaces, and means for drawing said clamp member and said wedge members together into clamping relationship with associated ones of said wedge surfaces to secure said drum segments together.

8. Apparatus according to claim 7, wherein said blocks border a central aperture of said drum to receive a portion of said drive shaft assembly.

9. Apparatus according to claim 7 and further including a pair of wedge members mounted on respective ones of said drum segments adjacent an end of said drum opposite the end containing said blocks, and a clamp member for urging said wedge members together to secure said drum segments together.

10. Apparatus according to claim 7, wherein said drawing means comprising a threaded bolt connected between said wedge members and said clamp member.

* * * * *